US005317856A

United States Patent [19]

Peter

[11] Patent Number: 5,317,856

[45] Date of Patent: Jun. 7, 1994

[54] COMPOSITE STRUCTURE OF WOOD AND REINFORCED CONCRETE, A COMPOSITE GIRDER AND A DOME SHAPED LOAD BEARING STRUCTURE INCLUDING SUCH COMPOSITE STRUCTURE

[76] Inventor: Emil Peter, Dammweg 314, CH-8460 Marthalen, Switzerland

[21] Appl. No.: 881,117

[22] Filed: May 11, 1992

[30] Foreign Application Priority Data

May 13, 1991 [CH] Switzerland ..... 1420/91-8

[51] Int. Cl.[5] ..... E04C 3/34

[52] U.S. Cl. ..... 52/723; 52/89; 52/329; 52/642; 52/644

[58] Field of Search ..... 52/723, 724, 693, 319, 52/335, 329, 339, 6, 86, 82, 88, 89, 94, 81.1, 81.2, 81.3, 80.2, 639, 642, 644; 249/26, 40, 48, 50

[56] References Cited

U.S. PATENT DOCUMENTS

| | | | |
|---|---|---|---|
| 1,761,306 | 6/1930 | McKeown | 52/639 |
| 1,792,040 | 2/1931 | Schaub . | |
| 4,189,882 | 2/1980 | Harrison et al. | 52/222 |
| 4,223,495 | 9/1980 | Peter | 52/87 X |
| 4,357,782 | 11/1982 | Peter | 52/644 X |
| 4,704,754 | 11/1987 | Bonasso | 52/723 X |
| 4,924,638 | 5/1990 | Peter | 52/644 X |

FOREIGN PATENT DOCUMENTS

| | | |
|---|---|---|
| 790706 | 9/1935 | France . |
| 2589631 | 5/1987 | France . |

OTHER PUBLICATIONS

European Search Report; Feb. 10, 1992.

*Primary Examiner*—Carl D. Friedman
*Assistant Examiner*—Kien Nguyen
*Attorney, Agent, or Firm*—Diller, Ramik & Wight

[57] ABSTRACT

The composite structures are composed of wooden members such as girders of laminated wooden boards and members of reinforced concrete such as a plate of reinforced concrete which form for instance a composite load supporting structure designed as pedestrian walkway or similar structure. In order to interconnect the members of wood themselves or to members made of reinforced concrete fitted set bolts or fitted screw bolts, respectively, are arranged in such a manner that they extend through the cross sections of the wooden members and are anchored at least in one cross section of reinforced concrete. The parts consisting of reinforced concrete are poured as a rule after the assembling of the wooden structure such that deviations of dimensions can be equalized or taken up, respectively, quite easily. This allows a combining of the advantages of wooden structures and of structures made of reinforced concrete.

30 Claims, 5 Drawing Sheets

FIG. 12
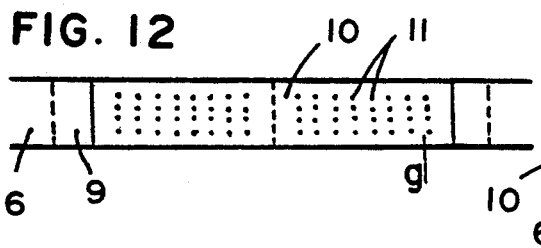
FIG. 13h
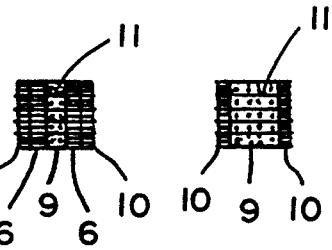
FIG. 13g
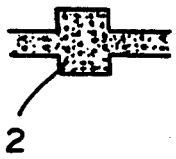
FIG. 13k
FIG. 14
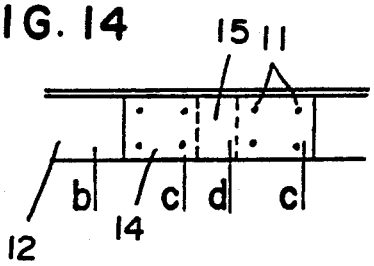
FIG. 15c
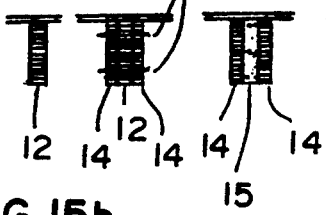
FIG. 15b
FIG. 15e
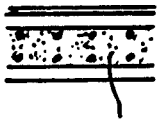
FIG. 15d
FIG. 16d'
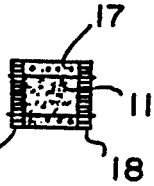
FIG. 16b'
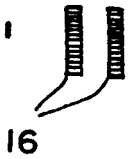
FIG. 16c'
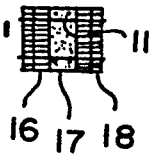
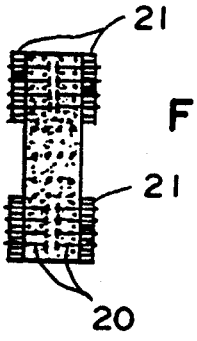
FIG. 16m
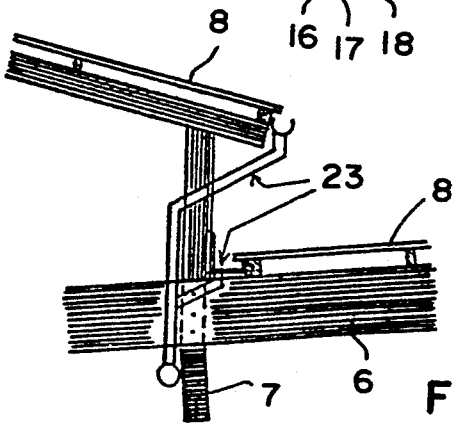
FIG. 17

COMPOSITE STRUCTURE OF WOOD AND REINFORCED CONCRETE, A COMPOSITE GIRDER AND A DOME SHAPED LOAD BEARING STRUCTURE INCLUDING SUCH COMPOSITE STRUCTURE

BACKGROUND OF THE INVENTION

1. Field of the Invention

The present invention relates to a composite structure of wood and reinforced concrete. It also relates to a composite girder including a composite structure of wood and reinforced concrete. It also relates to a dome shaped load bearing structure including such composite structure of wood and reinforced concrete.

2. DESCRIPTION OF THE PRIOR ART

At the present time there is generally the requirement to use materials of wood in an increased manner for halls, hangers and other supporting structures having long spans. A known building procedure includes the use of girders of laminated wooden boards having large cross sections at high surface loads. Forces encountered in such structures are highly concentrated. This concentration can lead to problems at joints and junctions because the magnitude of allowable forces at joints and junctions of wooden structures is limited. Further known are framework or lattice, respectively, structures which, however, necessitate complicated and intrinsic jointing elements. Wooden structures pose, furthermore, the problem that the individual elements of the structure must be laid out prior to the final assembling in order to allow the dimensions of the individual members and of the bores to be exactly matched to each other for the mutual connections. These procedures are intrinsic and time consuming and need a large precision. And in spite thereof it is still necessary to make further adjustments during the final assembly and building.

Structures made of reinforced concrete are known for a long time, including their advantages and drawbacks. The drawbacks of such reinforced concrete structures are the need to construct corresponding time and cost consuming intrinsic false works and that the structures themselves are of a large weight.

SUMMARY OF THE INVENTION

It is, therefore, a general object of the invention to provide a composite structure, in which the respective advantages of wooden constructions and reinforced steel constructions complete each other in such a manner that it is possible to design therewith building structures having small momentums of their own weight, without complicated false works and without high demands regarding precise dimensions of the individual members or elements, respectively.

A further object is to provide a composite structure of wood and reinforced concrete which comprises structural members of wood and structural members of reinforced concrete and interconnecting members which interconnect the structural members of wood and the structural members of reinforced concrete and are arranged in such a manner that they project through the cross sections of the structural members of wood and are molded into at least one cross section of reinforced concrete. Yet a further object is to provide a composite girder having a composite structure of wood and reinforced concrete including structural members of wood and structural members of reinforced concrete and interconnecting members which interconnect the structural members of wood and the structural members of reinforced concrete and are arranged in such a manner that they project through the cross sections of the structural members of wood and are molded into at least one cross section of reinforced concrete, which composite girder comprises an upper plate made of reinforced concrete, and at least one girder of laminated wooden boards at its bottom side, which at least one girder of laminated wooden boards is mounted by means of fitted set bolts to the plate made of reinforced concrete or to longitudinal ribs made of concrete formed at the plate made of reinforced concrete.

Yet a further object is to provide a dome shaped load bearing structure including a composite structure of wood and reinforced concrete having structural members of wood and structural members of reinforced concrete and interconnecting members which interconnect the structural members of wood and the structural members of reinforced concrete and are arranged in such a manner that they project through the cross section of the structural members of wood and are molded into at least one cross section of reinforced concrete, and having at least one tension arch structure of a catenary shape resting at its respective ends on the supports, which tension arch structure comprises as structural members of wood tension spars extending in the direction of the arch, which tension spars include tension plates at tension junctions, between which tension plates a respective disc of reinforced concrete is located, which tension junctions or tension spars, respectively, are anchored by means of fitted set bolts at said disc of reinforced concrete.

The connection between the structural members of wood themselves or between the structural members of wood and the structural members of reinforced concrete is made by fitted set bolts which as such are already known. The wooden members, into which initial bores for these fitted set bolts have previously been made, can be connected in a force locked manner to a body of reinforced concrete preferably after the assembling and the mounting of the bolts in that concrete is poured into the corresponding cross sections. The advantage of this procedure and design is, among others, that any deviations regarding dimensions at the structures of wood and of the earlier made bore holes for the fitted set bolts are taken up by the concrete. A preferred embodiment includes respective twin cross section members and reinforced concrete arranged between such members such that the portion of wood which swells and also which shrinks can be reduced to less than half. Furthermore, it is possible to adjust the connection to the forces to be connected or transferred, respectively, by selecting the number of cross sections which are equipped with fitted set bolts. A further advantage is that at junctions of members connecting forces occur which act only in the direction of the fibers of the wood. Accordingly, it is possible to connect the structural members of wood by a simple design also for relatively large forces.

The composite structure design finds use for various structures or building structures, respectively.

BRIEF DESCRIPTION OF THE DRAWINGS

The invention will be better understood and objects other than those set forth above will become apparent when consideration is given to the following detailed description thereof. Such description makes reference to the annexed drawings, wherein:

FIG. 12 illustrates a tension junction of tension spars;

FIGS. 13 g, h, k are sections along the lines g, h, k of FIGS. 9 and 12;

FIG. 14 illustrates a pressure junction of pressure spars;

FIGS. 15 b, c, d, e are sections along the lines b, c, d, e of FIG. 10;

FIGS. 16 b', c', d', m are sections along the lines b', c', d', m of FIG. 11; and FIG. 17 illustrates on an enlarged scale a view of the gable roof like super structure shown in FIG. 5.

DESCRIPTION OF THE PREFERRED EMBODIMENTS

Figure 1:
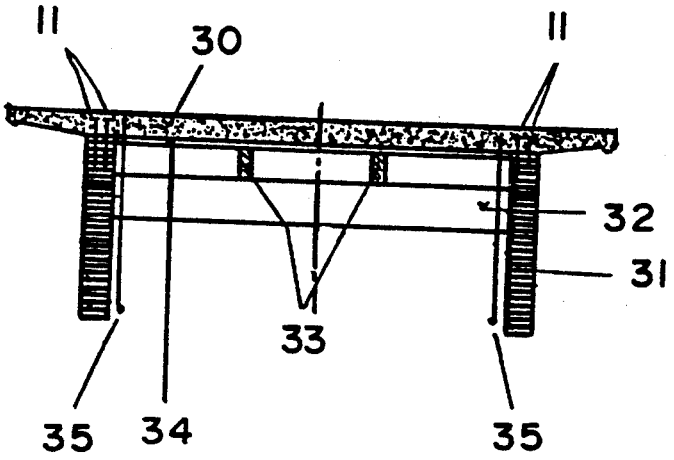
FIG. 1 illustrates a composite girder made up of structural members of wood and structural members of reinforced concrete.

FIG. 1 illustrates a T beam structured as composite girder made of structural members of wood and reinforced concrete. The structures .Of wood consist substantially of two girders 31 of laminated wooden boards and cross beams 32 extending between the girders 31. Casing supports 33 which support a wooden casing 34, i.e. concrete mold, lie on the cross beams 32.

Fitted set bolts 11 are anchored in the girders of laminated wooden boards. After this above described structure has been assembled, a roadway plate 30 of reinforced concrete is poured into the wooden casing 34. The anchoring of the roadway plate to the girders of laminated wooden boards is made via the fitted set bolts 11. Tension steel rods 35 adapted to take up tension forces are located within the structures such as illustrated in FIG. 1, which tension steel rods 35 are tensioned after the pouring of the concrete.

Figure 2:
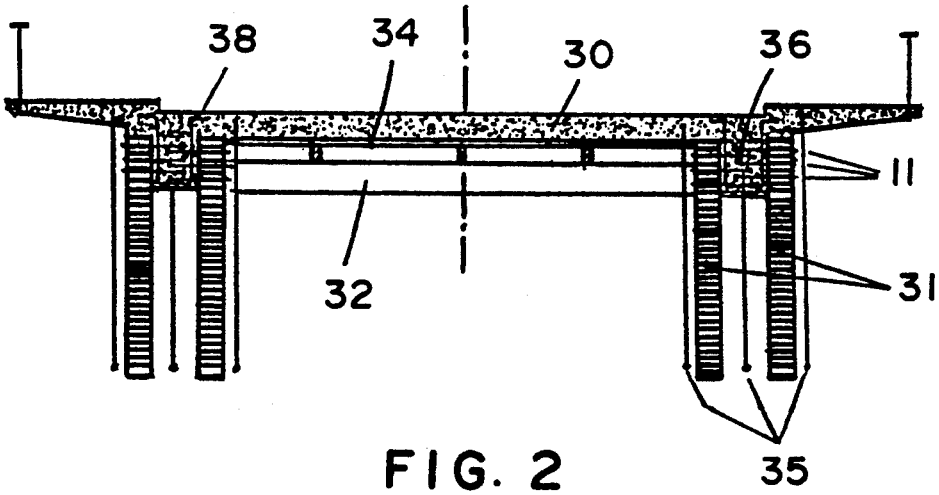
FIG. 2 illustrates a section of a span of a bridge extending over a plurality of supports and having no false work.
Figure 3:
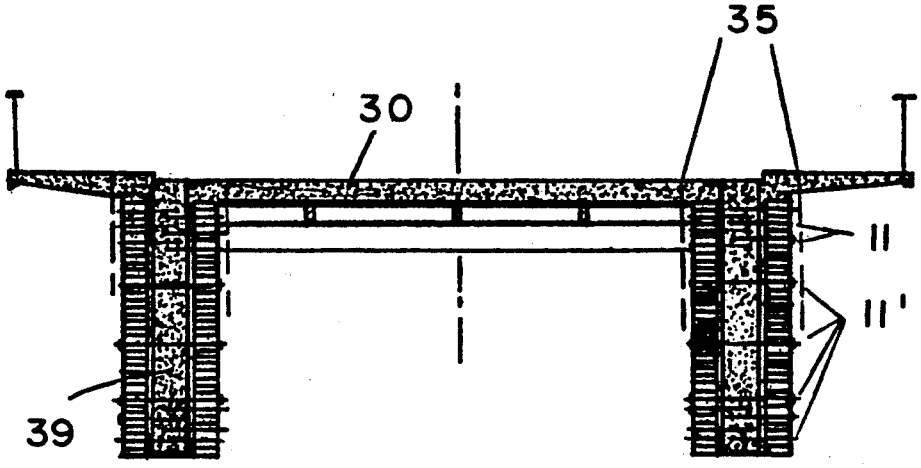
FIG. 3 is a cross section of the bridge according to FIG. 2 at a supporting column.

FIGS. 2 and 3 illustrate a corresponding composite structure with reference to a bridge extending over a plurality of supporting coles and without any false work. FIG. 2 is a cross section through a bay section of the bridge and FIG. 3 a cross section at a support. The structure of this bridge contains similar to the design of FIG. 1 structural members of wood in form of girders 31 made of laminated wooden boards, which in this embodiment are designed as twin cross section structures.

Also here cross beams 32 extend between the two twin cross section girders 31 of laminated wooden boards, which girders 31 support via casing supports 33 the wooden casing 34, i.e. mold for the concrete to be poured. The roadway plate which is a reinforced concrete structure positioned on the wooden casing 34 includes two longitudinally extending ribs 36. In the final mounted or assembled, respectively, state the girders 31 of each twin cross section are anchored by means of fitted set bolts 11 laterally at a respective rib 36. Connecting brackets 38 projecting into the roadway plate 30 are provided at the area of the ribs. The concrete supports 39 (FIG. 3) extend also between the girders 31 of laminated wooden boards of each twin cross section structure. These girders 31 are anchored at the supports by means of fitted set bolts 11 or fitted screw bolts 11', respectively, along their entire height. In order to additionally take up tension forces tension steel rods 35 extend also here at the side of the girders 31 of laminated wooden boards.

As already mentioned above, it is possible to initially assemble and mount the wooden structure, whereafter the roadway plate 30 of concrete is poured and the tension steel rods 35 are tensioned. A specific preciseness regarding the arrangement of the interconnecting fitted set bolts 11 is thereby not necessary.

Figure 4:
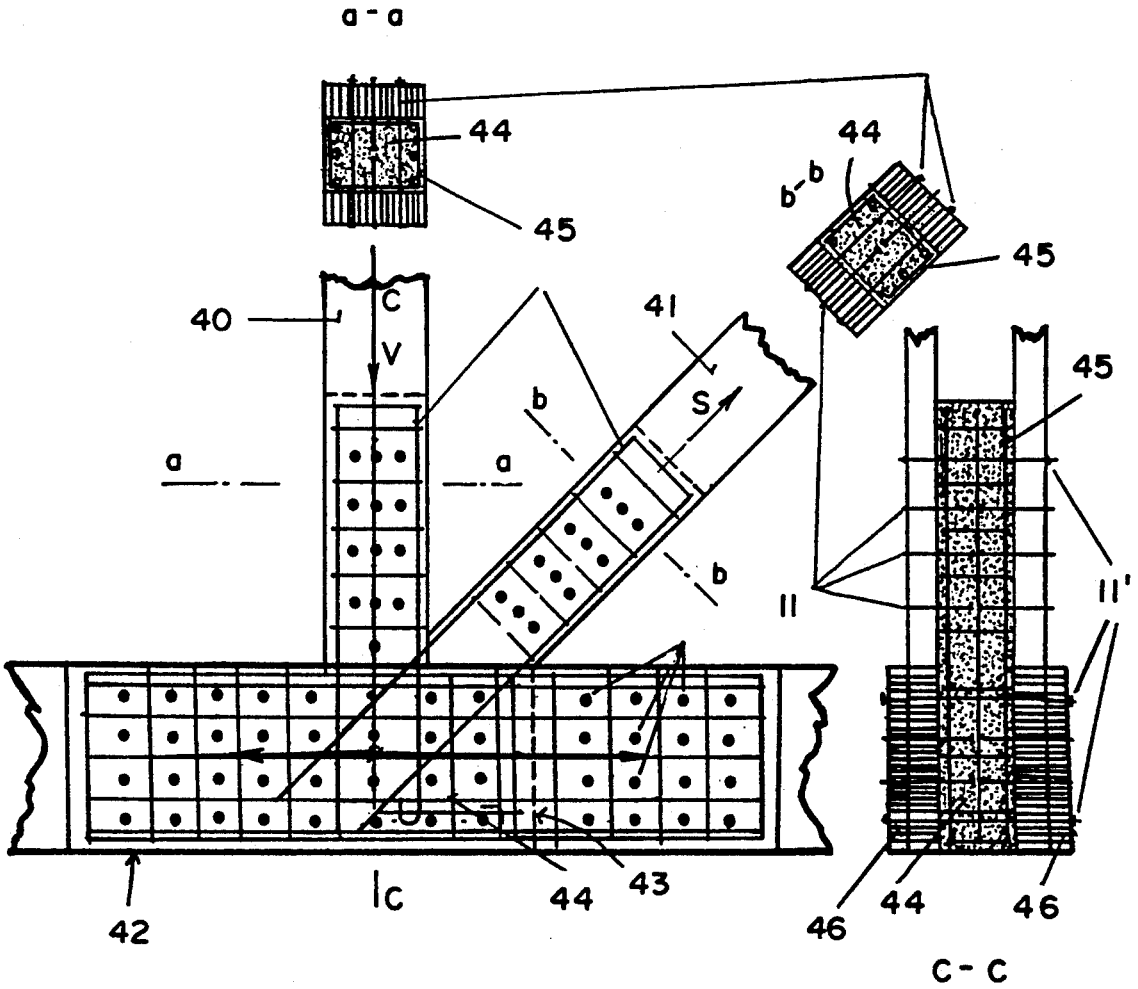
FIG. 4 illustrates a junction of a lattice girder and the corresponding cross sections.

FIG. 4 illustrates an embodiment, in which the longitudinally extending ribs are structured as lattice girders of wood. FIG. 4 depicts specifically a joint at a lattice girder where a support 40, a strut 41 and a lower chord 42 of the girder are Joined and additionally the sections a-a, b-b and c-c are designed, too. The junction 43 of the lower chord is, thereby, preferably located in this joint. The support 40, strut 41 and lower chord 42 are designed as twin cross section members made of structural members of wood, such as clearly visible in the illustrated cross sections thereof. Now, a disc 44 of reinforced concrete and including reinforcing baskets or rebar 45 is located at the area of this joint or junction, respectively. The anchoring of the twin cross sections of wood at the reinforcing disc 44 proceeds by means of fitted set bolts 11 and fitted screw bolts 11'. Two tension plates 46 are located at the sides of the twin cross section of the lower chord 42 at the area of the junction, which tension plates 46 interconnect two wooden members of the lower chord 42 abutting each other and are anchored via fitted threaded bolts in the disc 44 of reinforced concrete. The number of fitted set bolts and fitted screw bolts, respectively, is selected in accordance with the forces to be transmitted at the Joint. The forces intersect each other in the joint exactly at its center of gravity. In the wooden members connecting forces are present which act only in the longitudinal direction of the fibers. At the joints the cross sections of the wooden men, bets and structures can be selected to be rather slim, such that the influence of the swelling and shrinking of the wood can be reduced.

Figure 5:
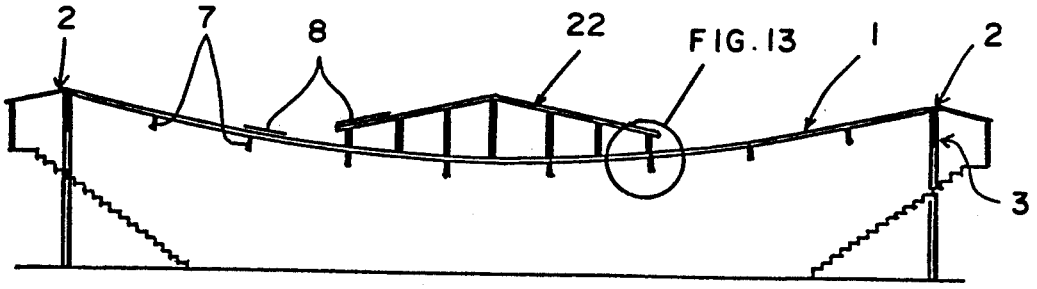
FIG. 5 is a cross section through the tension arch structure of a dome shaped load bearing structure.
Figure 6:
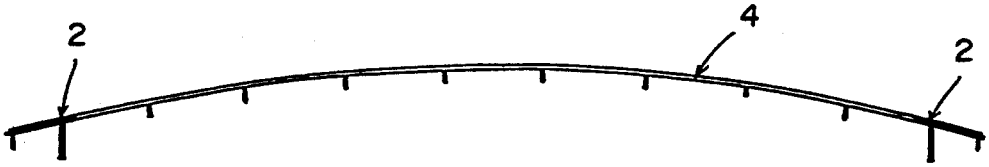
FIG. 6 is a cross section through a pressure arch structure located adjacent the tension arch structure of FIG. 5.
Figure 7:
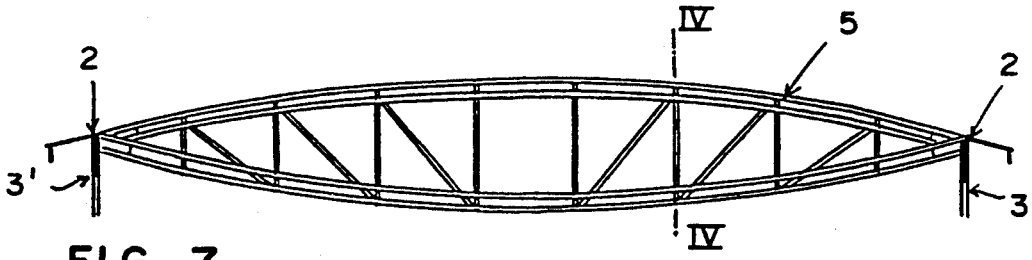
FIG. 7 illustrates one of the trusses located between the tension arch structure and the pressure arch structure.
Figure 8:
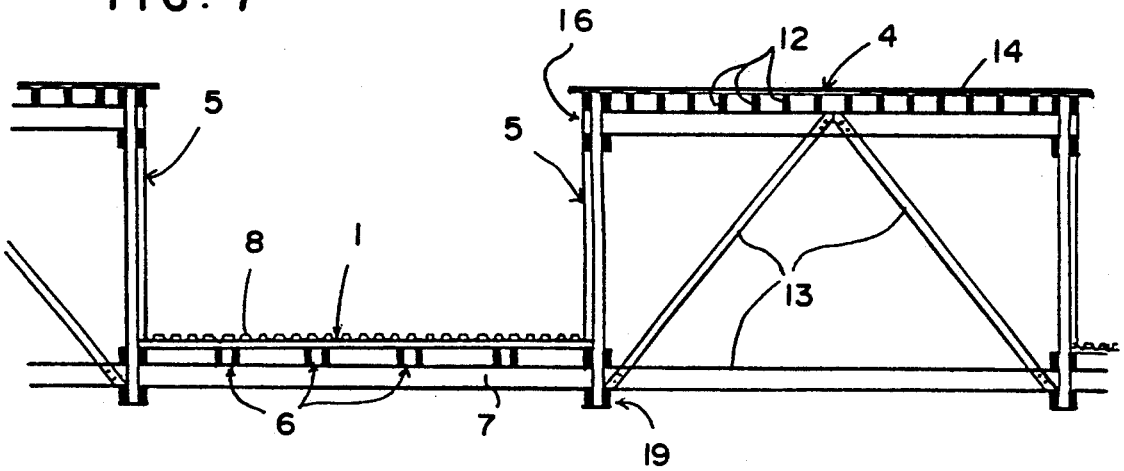
FIG. 8 is a section along line IV—IV of FIG. 7.

The following embodiment refers to a hall or hangar, respectively, having a span width of e.g. 70 m, which hall can be used as indoor riding court, covered playing field (example: Astro-Dome) or similar applications. This riding hall is illustrated in FIGS. 5 to 7 at a scale of about 1:500, whereas the FIGS. 8 and 17 are designed on a scale of about 1:200 and the other figures on a scale of about 1:50. The width of the hall is given by the number of adjacently located tension and pressure arches, of which each has a width of about 15 meters. It shall, however, be distinctly noted that these dimensions are given by example only and not by way of restriction and that it is possible to design halls of a still larger width in accordance with the here illustrated structural procedure.

The dome shaped load bearing structure of FIGS. 7 and 8 includes a tension arch 1 (FIGS. 5 and 8) of a catenary shaped pattern which is connected to a support 3 at both its ends via a respective supporting disc 2 made of concrete. This support 3 may be integrated in the structure of a grandstand.

Immediately adjacent this tension arch 1 a pressure arch 4 (FIGS. 6 and 8) is provided, which is also connected via the supporting discs 2 of concrete to the supports 3.

A truss 5 (FIGS. 7 and 8) is located between the respective tension arches and pressure arches. The truss 5 is mounted at the one side to a movable and at the other side to a stationary support.

Figure 9:
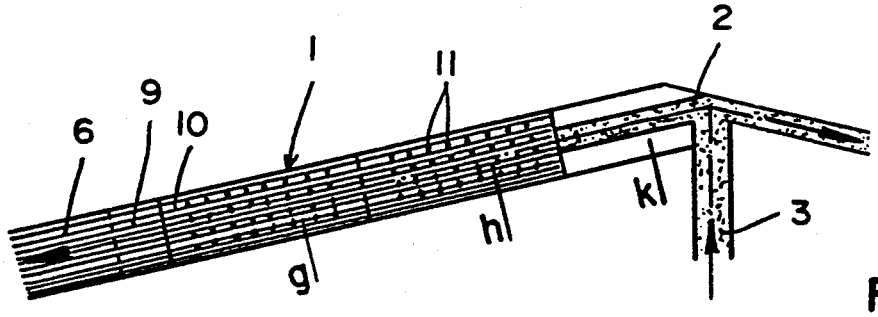
FIG. 9 illustrates the joint between a tension spar and one of the supporting discs of concrete.

FIG. 8 illustrates in section the tension arch 1 of FIG. 5 the pressure arch 4 of FIG. 6 which re interconnected by the truss 5. FIG. 8 illustrates furtheremore that the tension arch 1 includes tension spars 6 made of wood or of hollow steel profile members which are designed as twin cross sections and extend in the direction of the arch, which tension spars 6 absorb the tension forces. The tension spars 6 rest on beams 7 extending perpendicularly thereto between two adjacent trusses 5. The roof casing of the tension arches 1 can consist of translucent plates 8, e.g. of transparent corrugated roof plates which do not absorb tension forces on their own. Accordingly skylights are formed at the tension arches 1 which extend in the direction of the arch. The wooden tension spars 6 of the tension arches 1 may be connected directly to the supporting discs 2 of concrete such as specifically clearly shown in FIGS. 9 and 14. Hereto cross sections 9 of tension-reinforced concrete are foreseen between the twin cross sections of wood and tension plates 10 made of wood or of steel are placed laterally at the twin cross sections of the tension spars 6, which tension plates 10 are connected to each other by means of fitted set bolts or fitted screw bolts 11, respectively. A corresponding connection is foreseen at the tension junctions of the tension spars 6 such as illustrated in FIG. 12. The cross sections of concrete which are tension-reinforced pass into the concrete supporting disc 2. By this design the tension forces of the own weight and of the live load can be transferred via relatively small cross sections directly to the supports.

Figure 10:
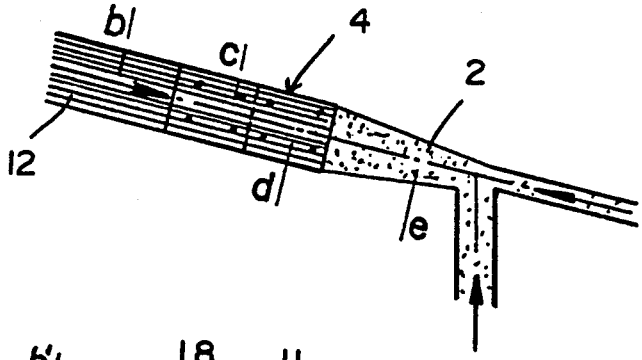
FIG. 10 illustrates the joint between a pressure spar and a supporting disc of concrete.

FIGS. 8, 14 and 15 illustrate that the pressure arches 4 are of a similar design. Pressure spars 12 of wood extend here in the direction of the arch and form together with the casing (mold) and the lateral trusses 13 a structure having a high resistance to buckling. The pressure forces are transmitted via the pressure spars 12 directly into the supporting discs of concrete, such as illustrated in FIG. 10 and by the sectional views b, c, d and e of FIG. 15. At the side of every pressure spar 12 plates 14 of wood or steel are mounted and connected by means of fitted set bolts or screw bolts 11. Between the plates 14 a tension reinforced concrete cross section 15 is foreseen, which passes into the supporting disc 2 of concrete. FIG. 14 illustrates a pressure Junction between the pressure spars which correspondingly includes two lateral plates 14 which are interconnected by fitted set bolts, whereby the pressure Junction itself is formed by a concrete cross section 15.

Figure 11:
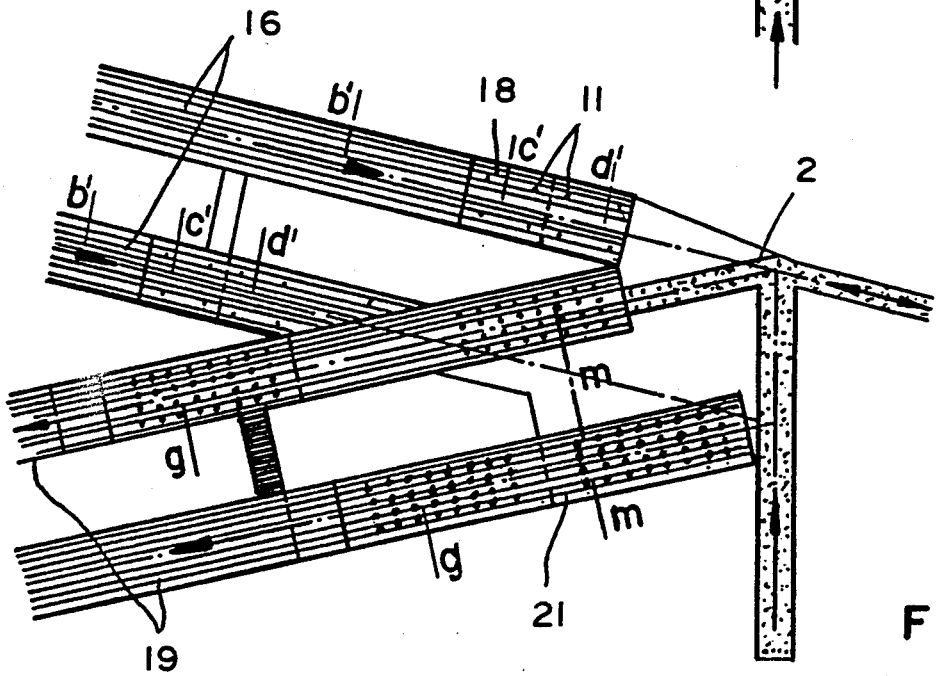
FIG. 11 illustrates the connection between a truss and a supporting disc of concrete.

Finally, the trusses 5 are structured of wooden members in accordance with generally known procedures and their connections to the supporting discs 2 of concrete are illustrated in FIG. 11 and the corresponding cross sections b', c', d', g and m in accordance with FIGS. 13 and 16.

The pressure members 16 which are made of wood are designed here also as twin cross sections, between which a respective tension reinforced concrete cross section 17 is foreseen at the area of the joint, whereby plates 18 of wood or steel are located at the sides of the twin cross section and are connected by means of fitted set bolts 11, respectively. The connection of the tension members 19 of the truss 5 proceeds correspondingly. At the section m (FIG. 16) the laterally located tension plates 21 are anchored in the supporting disc 2 of concrete by means of fitted set bolts 20.

In FIG. 5 it can be seen that the tension arch has at its center area a low inclination or slope, respectively, towards the center. This inclination is lower than the prescribed minimal value of 15%, which is necessary for a sufficient self-cleaning of the transparent corrugated roof plates and simultaneously for a safe guiding away of water on the roof. For this reason a superstructure in shape of a gable roof 22 is foreseen at this center area, of which the roof has the prescribed inclination and can also be covered by transparent corrugated roofing boards 8. FIG. 17 illustrates that this superstructure 22 on the roof is connected at the area of a lower beam 7 to the tension spars 6, i.e. it is bolted thereto between the twin cross section. Thereby gutters and down spouts 23 for the water of the tension arch and also of the superstructure 22 on the roof are foreseen at the connection area.

In order to build or assemble, respectively, the described dome shaped load bearing structure, the trusses are installed firstly and thereafter the tension arches and pressure arches installed before the supporting discs of concrete are poured, i.e. the cross sections of concrete of the joints and junctions are poured. The corresponding fitted bolts, fitted screw bolts and fitted set bolts are placed prior to the pouring of the concrete. By this procedure any deviations from precise dimensions of the members of wood are taken up by the concrete, which simplifies considerably the installation of the connections of the tension arches and pressure arches. After the supporting discs of concrete have been made, the trusses are lowered such that the tension arches and pressure arches support their own weight and transmit the corresponding forces into the supporting discs 2 of concrete.

The described structure consists essentially of wooden members having a cross section of $8 \times 50$ cm, of which the tension forces and pressure forces, respectively, are transferred individually into the supporting discs of concrete. This allows an avoiding of large concentrations of forces. The tension arches form translucent strips, which can be completed by window openings in the trusses, such that no artificial light is needed during daytime.

The explained embodiments illustrate the large variety of possibilities of applications of the inventive composite structure. Corresponding further applications are obvious for the person skilled in the art. By means of this composite structure the advantages of reinforced concrete structures can be combined with the advantages of wooden structures. It is possible to realize buildings having smaller momentums of their own weight, whereby high demands regarding precise dimensions of the individual members of the structure are not needed and which structures can be mounted and assembled without any intrinsic false works.

In case of smaller widths it is possible to use in the illustrated structures bolts having correspondingly small diameters, i.e. to use nails.

While there are shown and described present preferred embodiments of the invention, it is to be distinctly understood that the invention is not limited thereto, but may be otherwise variously embodied and practiced within the scope of the following claims.

I claim:

1. A unitized composite building structure comprising structural members of wood and structural members of reinforced concrete and a plurality of interconnecting means in situ molded within the reinforced concrete for permanently interconnecting the structural members of wood and the structural members of reinforced concrete, said interconnecting means being constructed and arranged such that they project through cross-sections of the structural members of wood and are permanently in situ molded into at least one cross-section of the reinforced concrete.

2. The unitized composite building structure as defined in claim 1, wherein said interconnecting means are defined by at least one of nails, bolts and screws.

3. The unitized composite building structure as defined in claim 1 wherein at least one structural member of reinforced concrete is sandwiched between two structural members of wood.

4. The unitized composite building structure as defined in claim 1 wherein at least one structural member of reinforced concrete is sandwiched between two structural members of wood, and said interconnecting means include fastening members having first ends in situ molded into said at least one structural member of reinforced concrete and opposite second ends secured to selected ones of said structural members of wood.

5. The unitized composite building structure as defined in claim 1 wherein said structural member of wood includes a first pair of spaced structural members of wood and a second pair of spaced structural members of wood having adjacent ends defining a junction, said structural member of reinforced concrete include at least one structural member of reinforced concrete common to said first and second pair of spaced structural members and defining therewith said junction, and said interconnecting means interconnect said at least one structural member of reinforced concrete to said first and second pair of spaced structural members of wood.

6. The unitized composite building structure as defined in claim 1 wherein said structural member of wood includes a first pair of spaced structural members of wood and a second pair of spaced structural members of wood having adjacent ends defining a junction, said structural members of reinforced concrete include at least one structural member of reinforced concrete common to said first and second pair of spaced structural members and defining therewith said junction, said interconnecting means interconnect said at least one structural member of reinforced concrete to said first and second pair of spaced structural members of wood, and said one structural member of reinforced concrete is sandwiched between both of said first and second pair of spaced structural members of wood.

7. The unitized composite building structure as defined in claim 1 wherein said structural member of wood includes a first pair of spaced structural members of wood and a second pair of spaces structural members of wood having adjacent ends defining a junction, said structural members of reinforced concrete include at least one structural member of reinforced concrete common to said first and second pair of spaced structural members and defining therewith said junction, said interconnecting means interconnect said at least one structural member of reinforced concrete to said first and second pair of spaced structural members of wood, and said interconnecting means include fastening members in situ molded in said one structural member of reinforced concrete and having ends secured to selected ones of said first and second pair of spaced structural members of wood.

8. The unitized composite building structure as defined in claim 1 wherein said structural member of wood includes a first pair of spaced structural members of wood and a second pair of spaced structural members of wood having adjacent ends defining a junction, said structural members of reinforced concrete include at least one structural member of reinforced concrete common to said first and second pair of spaced structural members and defining therewith said junction, said interconnecting means interconnect said at least one structural member of reinforced concrete to said first and second pair of spaced structural members of wood, said one structural member of reinforced concrete is sandwiched between both of said first and second pair of spaced structural members of wood, and said interconnecting means include fastening members in situ molded in said one structural member of reinforced concrete and having ends secured to selected ones of said first and second pair of spaced structural members of wood.

9. The unitized composite building structure as defined in claim 1 wherein said structural members of wood are elongated and having opposite end portions, at least said wood structural member opposite end portions are interconnected by said interconnecting means to said structural members of reinforced concrete and said elongated structural members of wood are curved to define at least one tension arch.

10. The unitized composite building structure as defined in claim 9 wherein said structural members of reinforced concrete at said wood structural members opposite end portions define opposite spaced supporting junctions for said at least one tension arch.

11. The unitized composite building structure as defined in claim 10 including reinforcing plates at said supporting junctions and being interconnected thereto by said interconnecting means.

12. The unitized composite building structure as defined in claim 10 wherein said wood structural members opposite end portions sandwich therebetween said reinforced concrete structural members at said supporting junctions.

13. The unitized composite building structure as defined in claim 10 including tension reinforcing plates at said supporting junctions and being interconnected thereto by said interconnecting means.

14. The unitized composite building structure as defined in claim 10 wherein said at least one tension arch is upwardly concavely curved.

15. The unitized composite building structure as defined in claim 1 wherein said structural members of wood are elongated and having opposite end portions, at least said wood structural member opposite end portions are interconnected by said interconnecting means to said structural members of reinforced concrete and said elongated structural members of wood are curved to define at least one compression arch.

16. The unitized composite building structure as defined in claim 15 wherein said structural members of reinforced concrete at said wood structural member opposite end portions define opposite spaced supporting junctions for said at least one compression arch.

17. The unitized composite building structure as defined in claim 16 including reinforcing plates at said supporting junctions and being interconnected thereto by said interconnecting means.

18. The unitized composite building structure as defined in claim 16 wherein said wood structural members opposite end portions sandwiched therebetween said reinforced concrete structural members at said supporting junctions.

19. The unitized composite building structure as defined in claim 16 including compression reinforcing plates at said supporting junctions and being interconnected thereto by said interconnecting means.

20. The unitized composite building structure as defined in claim 16 wherein said at least one compression arch is upwardly convexly curved.

21. The unitized composite building structure as defined in claim 1 wherein said structural members of wood are elongated and having opposite end portions, at least said wood structural member opposite end portions are interconnected by said interconnecting means to said structural members of reinforced concrete and said elongated structural members of wood are curved to define at least one tension arch and at least one compression arch.

22. The unitized composite building structure as defined in claim 21 wherein said structural member of reinforced concrete at said wood structural members opposite end portions define opposite spaced supporting junctions for said at least one tension arch and for said at least one compression arch.

23. The unitized composite building structure as defined in claim 22 including reinforcing plates at said supporting junctions and being interconnected thereto by said interconnecting means.

24. The unitized composite building structure as defined in claim 22 wherein said wood structural members opposite end portions sandwich therebetween said reinforced concrete structural members at said supporting junctions.

25. The unitized composite building structure as defined in claim 22 wherein said at least one tension arch is upwardly concavely curved and said at least one compression arch is upwardly convexly curved.

26. The unitized composite building structure as defined in claim 25 wherein said at least one tension arch and said at least one compression arch are laterally adjacent to each other.

27. The unitized composite building structure as defined in claim 22 wherein said at least one tension arch and said at least one compression arch are laterally adjacent to each other.

28. The unitized composite building structure as defined in claim 1 wherein said structural members of wood are elongated and have opposite end portions, at least said wood structural member opposite end portions are interconnected by said interconnecting means to said structural members of reinforced concrete and said elongated structural members of wood are curved to define at least one tension arch and at least one compression arch, and trusses connected between said tension and compression arches.

29. The unitized composite building structure as defined in claim 1 wherein said structural members of wood are elongated and have opposite end portions, at least said wood structural member opposite end portions are interconnected by said interconnecting means to said structural members of reinforced concrete and said elongated structural members of wood are upwardly concavely curved to define at least one tension arch.

30. The unitized composite building structure as defined in claim 1 wherein said structural members of wood are elongated and have opposite end portions, at least said wood structural member opposite end portions are interconnected by said interconnecting means to said structural members of reinforced concrete and said elongated structural members of wood are upwardly convexly curved to define at least one compression arch.

* * * * *

UNITED STATES PATENT AND TRADEMARK OFFICE

CERTIFICATE OF CORRECTION

PATENT NO. : 5,317,856

DATED : June 7, 1994

INVENTOR(S) : Emil PETER

It is certified that error appears in the above-identified patent and that said Letters Patent is hereby corrected as shown below:

On the title page: item [30] "Foreign Application Priority Data":

"May 13, 1991 [CH] Switzerland..... 1420/91-8"

should read:

-- May 13, 1991 [CH] Switzerland..... 1420/91-8
June 12, 1991 [CH] Switzerland..... 1420/91-8 --

Signed and Sealed this

Tenth Day of January, 1995

Bruce Lehman

*Attest:*

BRUCE LEHMAN

*Attesting Officer*

*Commissioner of Patents and Trademarks*